US005123825A

United States Patent [19]

Ernst

[11] Patent Number: 5,123,825

[45] Date of Patent: Jun. 23, 1992

[54] DEVICE FOR INSERTING TRANSPORT ANCHORS IN FORMS FOR CONCRETE PARTS

[75] Inventor: Peter Ernst, Hattersheim, Fed. Rep. of Germany

[73] Assignee: Detec Fertigung GmbH, Gross-Gerau, Fed. Rep. of Germany

[21] Appl. No.: 572,961

[22] PCT Filed: Mar. 10, 1989

[86] PCT No.: PCT/EP89/00252

§ 371 Date: Sep. 12, 1990

§ 102(e) Date: Sep. 12, 1990

[87] PCT Pub. No.: WO89/08540

PCT Pub. Date: Sep. 21, 1989

[30] Foreign Application Priority Data

Mar. 12, 1988 [DE] Fed. Rep. of Germany ..... 3808379

[51] Int. Cl.[5] ..... B28B 23/00

[52] U.S. Cl. ..... 425/126.1; 29/809; 249/91; 249/93; 249/95; 414/224; 414/226

[58] Field of Search ..... 425/111, 117, 126.1, 425/126.2; 249/86, 91, 93, 94, 95, 96, 97; 29/809; 198/468.2; 414/224-226

[56] References Cited

U.S. PATENT DOCUMENTS

| | | | |
|---|---|---|---|
| 2,506,966 | 5/1950 | Morin et al. | 425/126.1 |
| 3,553,798 | 1/1971 | Reckman et al. | 425/126.1 |
| 3,985,180 | 10/1976 | Boberg | 425/126.1 |
| 4,105,384 | 8/1987 | Mo rch | 425/126.2 |
| 4,653,185 | 3/1987 | Kajima et al. | 29/809 |
| 4,708,612 | 11/1987 | Pape | 425/117 |
| 4,726,562 | 2/1988 | Courtois et al. | 249/94 |

FOREIGN PATENT DOCUMENTS

| | | |
|---|---|---|
| 0230542 | 11/1986 | European Pat. Off. . |
| 3219139 | 11/1983 | Fed. Rep. of Germany . |
| 3413291 | 10/1985 | Fed. Rep. of Germany . |
| 8504360 | 10/1985 | World Int. Prop. O. . |

*Primary Examiner*—James C. Housel

*Attorney, Agent, or Firm*—Burns, Doane, Swecker & Mathis

[57] ABSTRACT

An apparatus for inserting transport anchors into a form for concrete parts comprises a magazine for feeding the anchors, and a gripper for removing anchors from the magazine and inserting the removed anchors into the form. The magazine orients a target anchor vertically, and jaws of the gripper close upon an end of the target anchor. The gripper is then rotated ninety degrees about a horizontal axis whereby the target anchor is removed from the magazine and reoriented to a horizontal position pointing toward the form. The gripper is then advanced transversely of the axis of insert the anchor into the form.

7 Claims, 2 Drawing Sheets

II
8
15
6
14
10
9
12
5
2
7
R
4
1
18
16
17
24
26
2
22A
20
21
22
25
3
II 8
9
12
11
2
13
25
19
19
F
29
20
20
18
18
17
16
21
21
22A
28
22
24
26
23
27

DEVICE FOR INSERTING TRANSPORT ANCHORS IN FORMS FOR CONCRETE PARTS

BACKGROUND OF THE INVENTION

Apparatus for the insertion of transport anchors, comprising an anchor shaft with a broadened anchor head and a broadened anchor foot, into forms for concrete parts, with an anchor magazine containing several transport anchors and an insertion gripper displaceable by means of a gripper advance device comprising two folding gripper jaws, which seize the anchor head and hold it in the casting form, while the anchor magazine is provide with guide rails guiding the transport anchors gripped immediately behind the anchor foot on both sides of the anchor shaft.

Transport anchors are inserted in concrete parts, in particular finished concrete parts, during their production, in order to facilitate their mounting on lifting tools for transportation and installation. The transport anchors, which are usually equipped with an anchor head, are inserted prior to the pouring of the concrete parts in the form, so that a recess remains on the surface of the concrete parts into which the anchor head protrudes. For this, the forms for the production of the concrete parts have openings, into which a gripper holding a transport anchor is introduced. The gripper, which for example consists of two gripper jaws in the shape of a calotte shell, simultaneously forms the recess into which the anchor head protrudes.

In order to automate the insertion process, an apparatus of the aforementioned generic type is known (WO 85/04360), in which the transport anchors are held available in an anchor magazine. Always the lowest transport anchor is ejected by an ejector device transversely to its longitudinal axis from the anchor magazine and moved into the motion path of the gripper, which here is displaceable longitudinally only. The gripper seizes the anchor head and pushes the transport anchor into the opening of the form, where it is held until the concrete part is finished.

This known apparatus has a relatively complex configuration and is therefore heavy. Considerable space is required as on the one hand the anchor magazine must be located closely adjacent to the transfer location to the insertion gripper, so that the path of the ejector device is not excessively long, and on the other, the insertion gripper must be moved from said transfer position in a straight line into the form. This requires a relatively long advance of the insertion gripper.

It is therefore the object of the invention to design an apparatus of the above-mentioned generic type so that it will have a significantly simpler configuration and be lighter, and that its space requirements will be reduced.

SUMMARY OF THE INVENTION

This object is attained according to the invention by that the insertion gripper may be pivoted around a pivot axle extending transversely to its longitudinal axis, between a removal position in which the longitudinal axis of the insertion gripper is aligned with the axis of the transport anchor to be taken from the anchor magazine, and an insertion position, by mans of a pivot drive device.

As the insertion gripper takes the transport anchor directly from the anchor magazine, the ejector device is completely eliminated, whereby the configuration of the apparatus is significantly simplified. Since the insertion gripper performs a pivoting motion between the removal of a transport anchor from the magazine and the insertion into the form, the anchor magazine may be located in a space saving manner adjacent to the insertion gripper, the anchor magazine does not interfere in the insertion area, so that the insertion gripper is required to carry out a relatively short moving stroke, as the form may be placed directly in front of the insertion gripper. This makes possible a highly space saving configuration of the entire apparatus.

According to a preferred embodiment of the invention, the pivoting drive is supported fixedly on a frame and carries the gripper advance device. This causes no design problems, as the gripper advance device is laid out for a short gripper stroke only and is therefore simple and light.

BRIEF DESCRIPTION OF THE DRAWING

The invention will become more apparent from an example of embodiment with reference to the drawing, in which.

DETAILED DESCRIPTION OF A PREFERRED EMBODIMENT OF THE INVENTION

Figure 1:
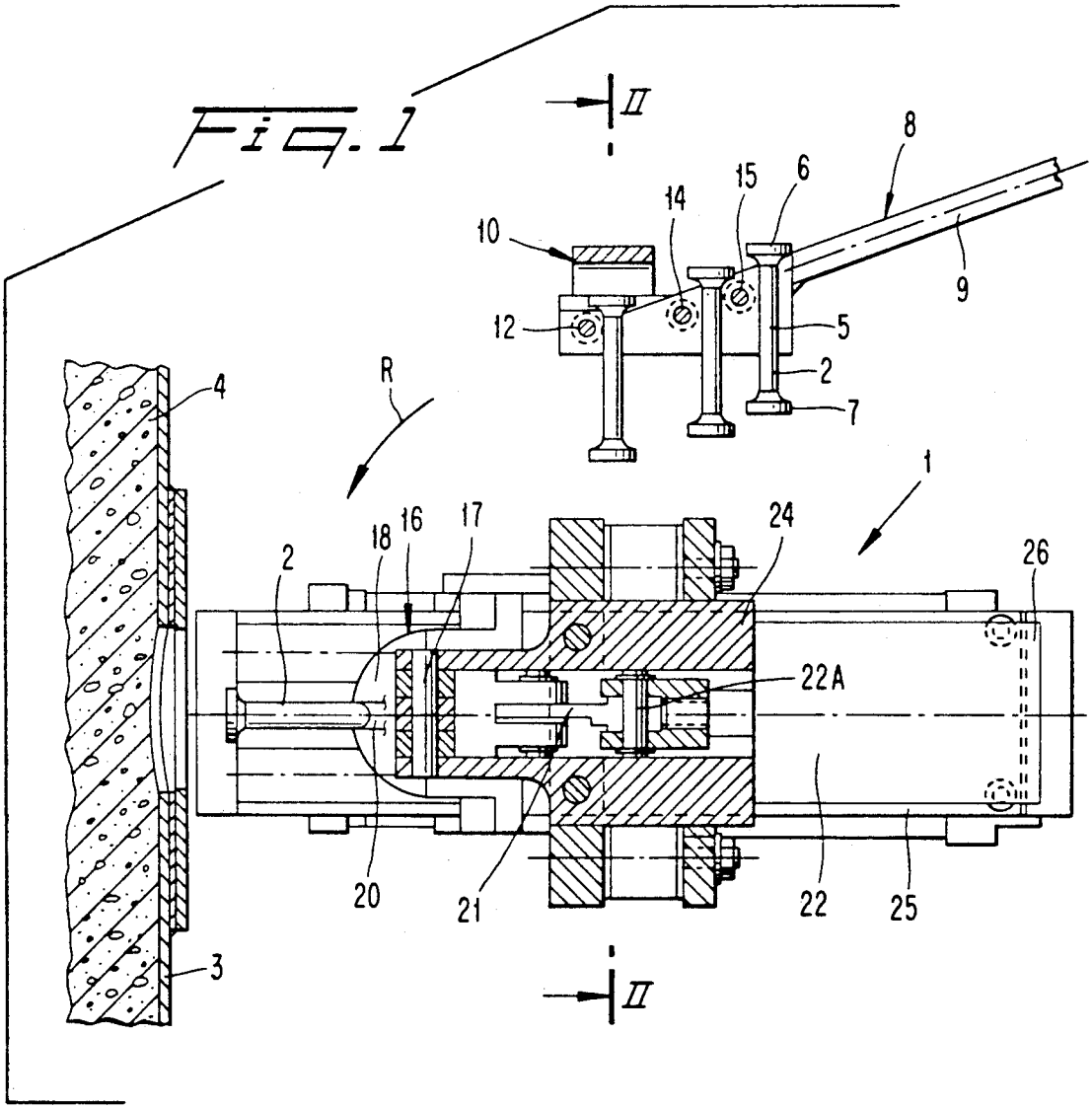
FIG. 1 shows a device for the insertion of transport anchors in a vertical section and after the device has removed a transport anchor from a magazine and has been rotated 90° about a horizontal axis from a removal position to an insertion position.

The device 1 shown in the drawing is intended to insert the transport anchor 2 into a from 3 of a pouring mold for concrete parts 4, in particular concrete pipes. The transport anchors 2 in the shape of plate anchors, comprise a cylindrical elongated anchor shaft 5. At one end of the anchor shaft 5 a plate shaped anchor foot 6 is located and on the opposite end a short, essentially cylindrical anchor head 7, also broadened relative to the anchor shaft 5.

The transport anchors to be inserted into the concrete part 4 are kept available in an anchor magazine 8. The anchor magazine has two parallel, spaced apart guide rials 9, which form a downward inclined path for the transport anchors 2 suspended in the magazine 8 with the anchor head 7 down. The free distance between the guide rails 9 is chosen so that the shaft 5 of the transport anchor 2 is taken up between them with a certain clearance. The guide rails 9 therefore guide the transport anchor 2 immediately after i.e., beneath, the anchor foot 6 on both sides of the anchor shaft 5.

At the lower removal end 10 the guide rails 9 form a removal opening 11 open toward the form 3, but blocked by a stop bolt 12 extending transversely relative to the guide rails 9. The stop bolt 12 is a pin that may be withdrawn by an activating element 13, for example a lifting magnet or a pneumatic cylinder, in order to release the transport anchor 2 located at the removal end 10.

In front of the removal end 10 of the anchor magazine 8 two inlet stop bolts 14 and 15 similar in shape to the stop bolt 12, are provided which again may be actuated in a controlled manner. The distance seperating the two inlet stop bolts 14 and 15 corresponds to the width of a transport anchor 2, so that always one anchor 2 may be taken up between the inlet stop bolts 14 and 15, as shown in FIG. 1. By the alternating actuation of the inlet stop bolts 14 and 15 and of the stop bolt 12, it is assured that always only one transport anchor 2 arrives from the anchor magazine 8 at the removal end 10 and may be removed from there following the opening of the stop bolt 12 by means of an insertion gripper 16, which is described as follows.

Figure 2:
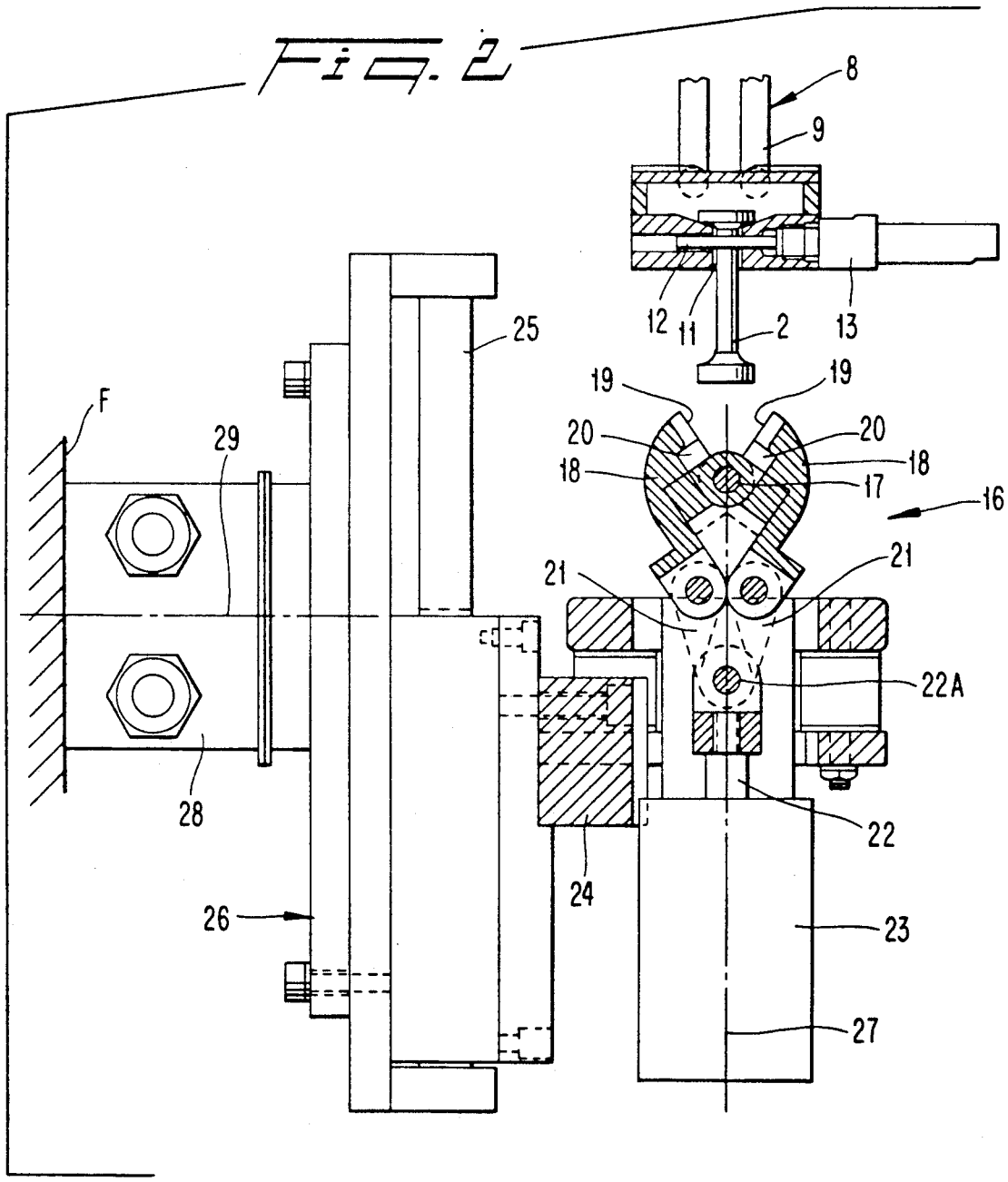
FIG. 2 a section through the line II—II in FIG. 1 when the device is still in the removal position and is in the process of removing a transport anchor from the magazine.

The insertion gripper 16 is depicted in two different positions in FIGS. 1 and 2. In FIG. 2, the insertion gripper 16 is in a removal position in which it is removing a transport anchor 2 from a magazine 8. Thereafter, the insertion gripper is rotated 90° about a horizontal axis 29 to an insertion position depicted in FIG. 1, whereby the transport anchor 2 becomes pointed toward the form 3.

The insertion gripper 16 has two gripper jaws 18 mounted pivotably on a common axle 17. In surfaces 19 of the jaws which form a common parting plane when the jaws are closed recesses 20 are provided, which together form a cavity to receive the anchor head 7. The gripper jaws 18 pivotingly located on the axle 17 are connected by means of a connecting rod 21 and a pivot 22*a* with a drive piston rod 22 of an actuation cylinder 23. If the drive piston rod 22 is withdrawn, the insertion gripper 16 is opened, as shown in FIG. 2. If the drive piston rod 22 is advanced, the insertion gripper 16 closes (FIG. 1).

The insertion gripper 16 is located on a slide 24, which may be displaced on guides 25 of a gripper advance device 26 in a direction parallel to the longitudinal axis 27 of the insertion gripper 16. The gripper advance device 26 is supported by a pivot drive device 28 and may be pivoted around a horizontal pivot axle 29. As indicated in FIG. 2, the pivot drive device 28 is mounted fixedly on a frame F.

In the removal position shown in FIG. 2 the insertion gripper 16 may be advanced toward the anchor magazine 8 by means of the gripper advance device 26 and subsequently closed by actuating the cylinder 23, whereby the jaws 18 close and grip the transport anchor 2 located at the removal end of the anchor magazine 8. Subsequently, the stop bolt 12 is withdrawn and the removal opening 11 is released. From this removal position, in which the longitudinal axis 27 of the insertion gripper is aligned with the longitudinal axis of the transport anchor 2 to be taken up, the insertion gripper 26 is pivoted by the pivot drive device 28 by 90° in a direction R and moved into its insertion position shown in FIG. 1. There the insertion gripper 16 with the transport anchor 2 is advanced in the direction of the gripper advance device until the transport anchor 2 and the hemispherical front part of the insertion gripper 16 defined by front ends of the closed jaws are projecting through an opening 30 into the form 3. The transport anchor 2 will thus become embedded with the concrete part 4 shaped by the form 3 as simultaneously a hemispherical recess is formed in the part 4 around the anchor head 7.

By the actuation the cylinder 23 the insertion gripper is opened and by actuating the gripper advance device 26 it is withdrawn from the form. Subsequently, the insertion gripper 16 may again be pivoted upward to receive the next transport anchor 2.

As the axle 17, around which the two gripper jaws 18 are pivoted, is located in the pivot plane of the insertion gripper 16 pivoting around the axle 29, the parting plane defined by the surfaces 19 of the closed jaws of the insertion gripper 16 coincides with the pivot plane. It is therefore possible to pivot the open insertion gripper 16 into the removal position, when it is already in its advanced position.

I claim:

1. Apparatus for inserting transport anchors into forms for concrete parts, comprising:

an anchor magazine for containing a plurality of transport anchors, said magazine including a removal section where the transport anchors are to be removed, and a gripper device mounted adjacent said magazine, comprising:

a gripping portion rotatable about an axis, said gripper portion including gripper jaws movable between an open position for receiving an end of a transport anchor and a closed position for gripping said end of a transport anchor, rotary drive means for rotating said gripper portion between a removal position in which said jaws are positioned adjacent said removal section of said magazine, and an insertion position wherein a transport anchor removed from said magazine extends toward a form for concrete parts, and means for reciprocating said gripper portion in a direction transversely of said axis.

2. Apparatus according to claim 1, wherein said magazine includes a pair of spaced apart guide rails for carrying the transport anchors therebetween, portions of said guide rails inclining downwardly forwardly toward a removal opening defined by said removal section, said opening lying within a plane in which said gripping portion rotates, a retractable stop element arranged to close said removal opening, and means for retracting said stop element to permit a transport anchor to be removed through said removal opening.

3. Apparatus according to claim 2 including at least one additional retractable stop element disposed rearwardly of said first-named stop element for preventing transport anchors from moving to a space adjacent said removal opening until said space is vacant.

4. Apparatus according to claim 3, wherein said at least one additional retractable stop element comprises a plurality of additional retractable stop elements spaced apart in a direction of travel of transport anchors within said magazine.

5. Apparatus according to claim 1, wherein said removal section of said magazine includes means for supporting transport anchors in a substantially vertical orientation in alignment with said jaws, said rotary drive means arranged to rotate said gripper device about a horizontal axis.

6. Apparatus according to claim 1, wherein said gripper portion rotates within a plane, said jaws being pivotable toward and away from one another about a pivot axis lying in said plane.

7. Apparatus according to claim 1, including a form into which the transport anchors are to be inserted, said magazine defining a removal opening through which the transport anchors are removed, said outlet opening being arranged such that the transport anchors being removed therethrough travel in a direction extending toward said form.

* * * * *